US006560423B2

(12) United States Patent
Matsubara

(10) Patent No.: US 6,560,423 B2
(45) Date of Patent: May 6, 2003

(54) IMAGE FORMING APPARATUS COMPRISING COMMUNICATION MEANS FOR COMMUNICATING WITH A MEMORY

(75) Inventor: Hideyuki Matsubara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/822,275

(22) Filed: Apr. 2, 2001

(65) Prior Publication Data

US 2001/0051053 A1 Dec. 13, 2001

(30) Foreign Application Priority Data

Apr. 5, 2000 (JP) ..... 2000-103139

(51) Int. Cl.[7] ..... G03G 15/00
(52) U.S. Cl. ..... 399/107; 399/25
(58) Field of Search ..... 399/12, 13, 24, 399/25, 26, 27, 107, 110, 111, 116, 118, 119, 177; 347/138, 152

(56) References Cited

U.S. PATENT DOCUMENTS 4,111,544 A * 9/1978 Steiner ..... 399/107 X
4,941,002 A * 7/1990 Maruyama ..... 347/138
5,572,292 A * 11/1996 Chatani et al. ..... 399/25
5,923,917 A * 7/1999 Sakurai et al. ..... 399/27
5,937,239 A * 8/1999 Watanabe et al. ..... 399/111

FOREIGN PATENT DOCUMENTS

JP 09-190138 A * 7/1997

* cited by examiner

*Primary Examiner*—Sandra Brase
(74) *Attorney, Agent, or Firm*—Fitzpatrick, Cella, Harper & Scinto

(57) ABSTRACT

A toner cartridge memory for detecting a toner cartridge information item is provided to shield a read/write circuit substrate from the outside. If the read/write circuit substrate is shielded from the outside, a shield member is anew installed, thus leading to an increase in the manufacturing cost of the relevant image forming apparatus. In order to shield a radiant noise with a simple arrangement, an image forming apparatus is provided which includes a unit detachably mountable on a main assembly, the unit having at least an image bearing member and a memory; an image writing unit for writing an image on the image bearing member in accordance with an image information; and a communication unit for communicating with the memory, in which the communication unit is arranged under the image writing unit; and the image writing unit functions to shield the: radiant noise emitted from the communication unit.

5 Claims, 7 Drawing Sheets

IMAGE FORMING APPARATUS COMPRISING COMMUNICATION MEANS FOR COMMUNICATING WITH A MEMORY

BACKGROUND OF THE INVENTION

1. Field of the Invention

The present invention relates to an image forming apparatus for forming a toner image on a sheet material and in particular to an image forming apparatus jointly comprising a mechanism for supplying toner and a memory for recognizing and storing the residual toner in the same mechanism.

2. Related Background Art

Conventionally, this type of image forming apparatus is provided on its toner cartridge and jointly comprises a non-volatile readable/ writable memory for retaining an information item about the residual toner quantity and a circuit substrate for reading/writing an information item from/into this non-volatile memory. The toner cartridge memory and the circuit substrate are provided apart from each other and the exchange of information between them is carried out without contact via a communicating antenna (antenna part).

FIG. 7 is a schematically sectional view showing one example of non-volatile readable/writable memory (toner cartridge) provided on such an image forming apparatus.

Reference Numeral 1 denotes a main frame (main body of image forming apparatus). Reference Numeral 2 denotes a scanner unit. Reference Numeral 3 denotes a toner cartridge and Reference Numeral 4 denotes a toner cartridge memory part. The toner cartridge memory part 4 is arranged at the front end of the toner cartridge 3 and comprises a read/write circuit substrate 5, an antenna part 6, a convey guide unit 7 and a cable 8 for linking a read/write circuit substrate 5 with an antenna part 6. The read/write circuit substrate 5 performs communication with an engine controller (not shown) of the main apparatus body 1. To perform the read/write of an information item to the toner cartridge memory part 4, this read/write circuit substrate 5 also makes a high-frequency current flow into the antenna part 6 not in contact with the same toner cartridge memory part 4 and generates a magnetic field (the magnetic-field generating region is as illustrated). This magnetic field is used to accomplish communication between the antenna part 6 (main apparatus body side) and the toner cartridge memory part 4 (toner cartridge memory side) and read/write a memory information item. The electric control for generating this manetic field is accomplished by means of the read/write circuit substrate 5. The high-frequency current used here is generated by an oscillator element in the read/write circuit substrate and its frequency is set to the order of several tens of MHz. As a result of this, radiant noises are generated from this read/ write circuit substrate 5.

In having a toner cartridge memory part 4 provided for detecting an toner cartridge information item like this, a countermeasure against radiant noises generated from the read/write circuit substrate 5 must be taken. For example, it is considered to shield the read/write circuit substrate 5 from the outside.

If the read/write circuit substrate 5 is shielded from the outside, however, a shield member is newly installed, thereby entailing an increase in the manufacturing cost of the relevant image forming apparatus.

SUMMARY OF THE INVENTION

The present invention is achieved in consideration of the above problem and its object is to provide an image forming apparatus capable of shielding the radiant noise generated from a communication part by using a simple construction.

It is another object of the present invention to provide an image forming apparatus including: a unit detachably mountable on a main assembly, the unit having at least an image bearing member and a memory; image writing means for writing an image on the image bearing member in accordance with an image information; and communication means for communicating with the memory, in which the communication means is arranged under the above image writing means; and the image writing means functions to shield the radiant noise emitted from the above communication means.

Further objects of the present invention will be clear by reading the following detailed description while referring to the appended drawings.

DETAILED DESCRIPTION OF THE PREFERRED EMBODIMENTS

First Embodiment

Figure 1:
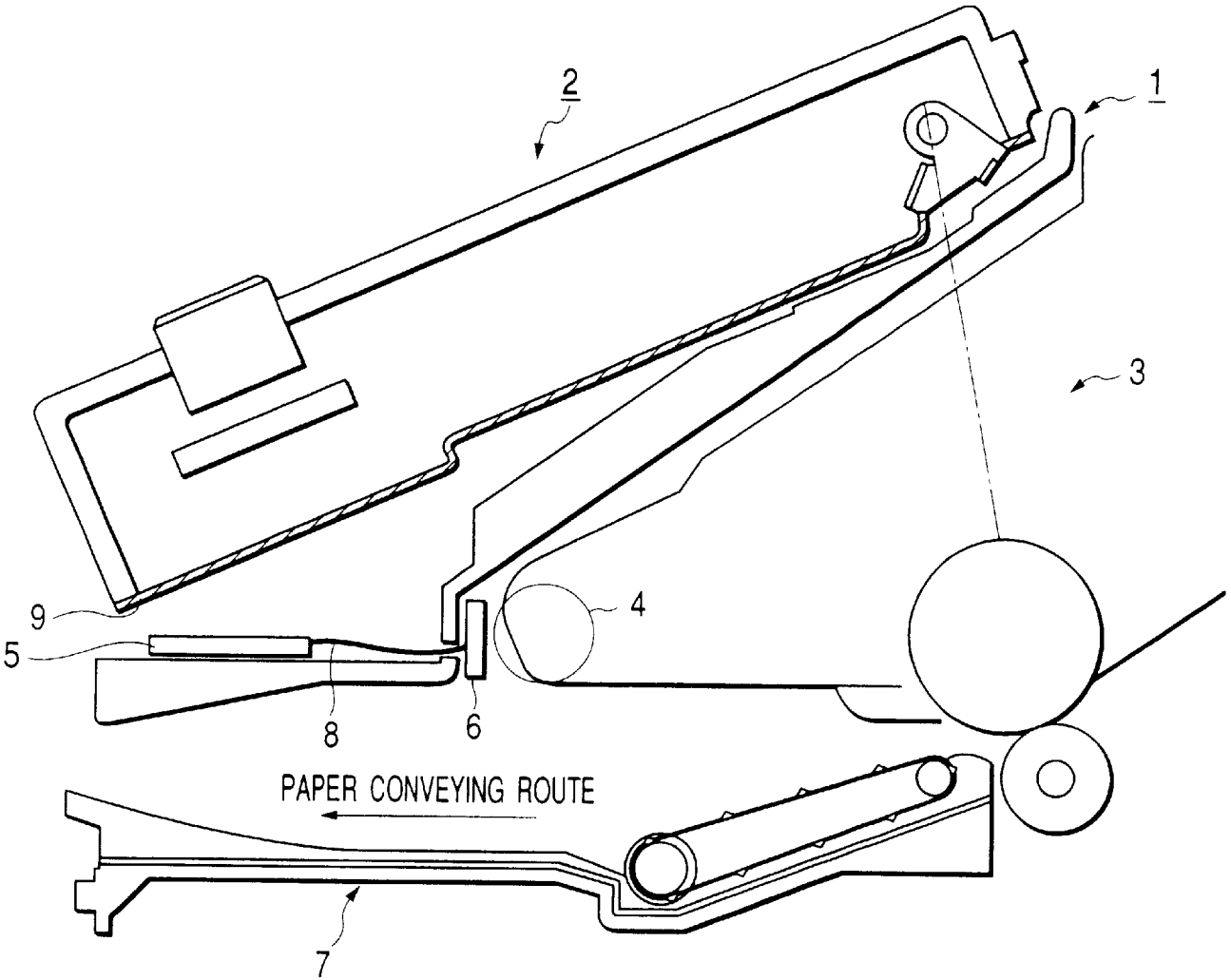
FIG. 1 is a laterally sectional view schematically showing a periphery of a toner cartridge memory part according to a first embodiment of the present invention.

Referring to the drawings, a first embodiment of the present invention will be described below.

FIG. 1 is a schematically sectional view showing the toner cartridge memory part in an image forming apparatus according to the first embodiment. Incidentally, in the apparatus of the first embodiment shown in FIG. 1, the same reference symbols are attached to those similar in function and structure to constituents of the conventional image forming apparatus described in FIG. 7 and the detailed description thereof will be omitted here.

In an image forming apparatus 1 according to the present invention, the bottom member 9 of a scanner unit part 2 is made of a sheet metal. The bottom member 9 is electrically connected to an unillustrated ground connection. The read/ write circuit substrate 5 is arranged at the lower part in the simplified view of the projective plane of the scanner unit 2.

According to these constitutions, the radiant noise generated from the read/write circuit substrate 5 and a emitter element for outputting a high-frequency current is reduced by means of a sheet metal of the bottom member 9 opposed to the arranged plane of the high-frequency of the read/write circuit substrate 5.

In this embodiment, the read/write circuit substrate 5 is arranged at the lower part in the approximately projective plane of the scanner unit 2, but may be at the upper part if arranged in the approximately projective plane.

Second Embodiment

Next, the second embodiment of the present invention will be described with a focus laid on different points from those of the first embodiment.

Figure 2:
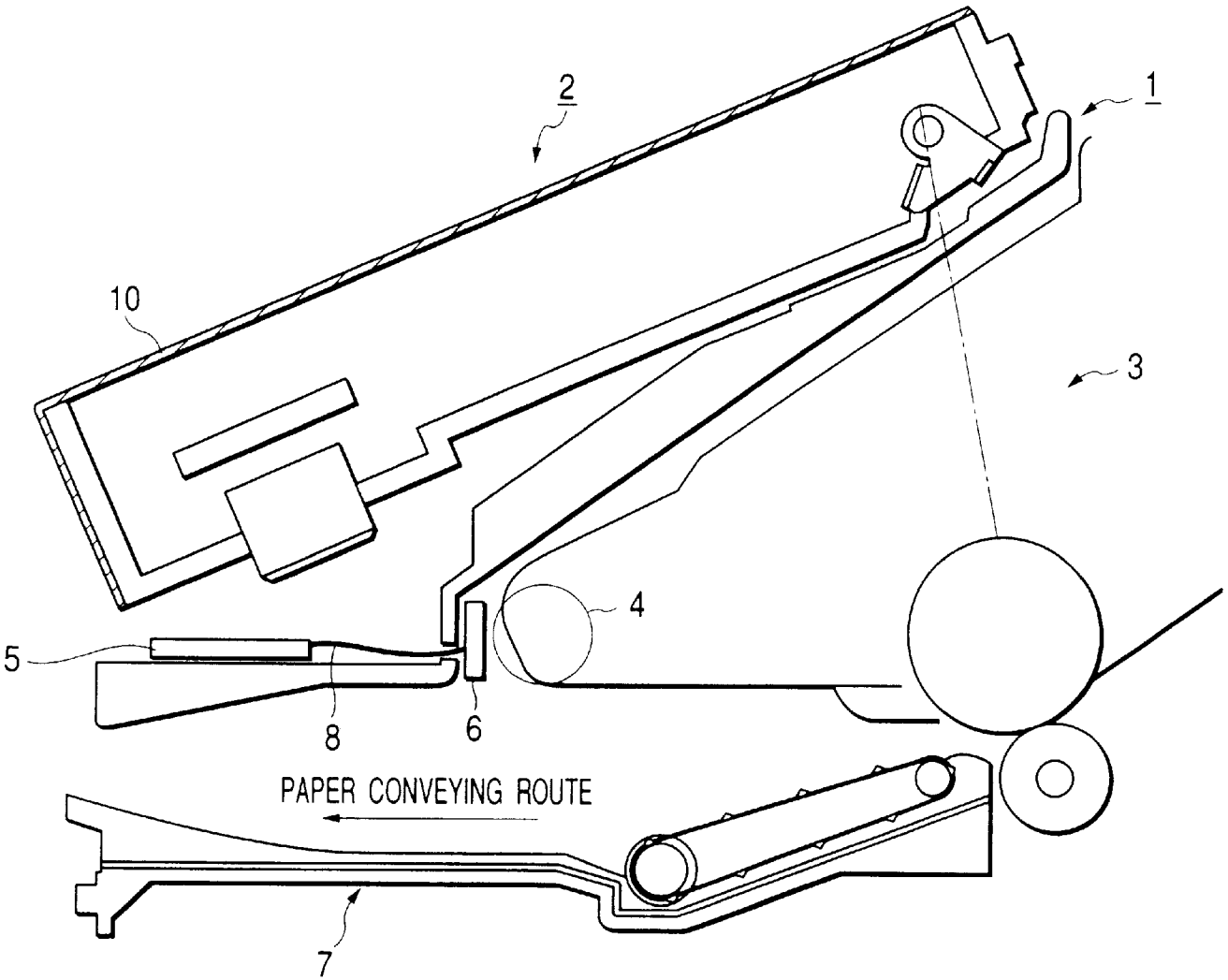
FIG. 2 is a laterally sectional view schematically showing a periphery of a toner cartridge memory part according to a second embodiment of the present invention.

FIG. 2 is a laterally sectional view schematically showing a toner cartridge memory part according to the second embodiment of the present invention. Incidentally, also with respect to the apparatus of the second embodiment shown in FIG. 2, the same reference symbols are attached to those similar in function and structure to constituents of the conventional image forming apparatus described in FIG. 7 and the detailed description thereof will be omitted here.

In an image forming apparatus 1 according to the present embodiment, the upper member 10 of a scanner unit part 2 is made of a sheet metal. The upper member 10 is electrically connected to an unillustrated ground connection. The read/write circuit substrate 5 is arranged at the lower part in the approximately projective plane of the scanner unit 2.

According to these constitutions, the radiant noise generated from the read/write circuit substrate 5, specifically an emitter element for outputting a high-frequency current, is reduced by means of a sheet metal of the upper member 10 opposed to the arranged plane of the high-frequency of the read/write circuit substrate 5. In this embodiment, the read/write circuit substrate 5 is arranged at the lower part in the projective plane of the scanner unit 2, but may be at the upper part if arranged in the projective plane.

Third Embodiment

Next, the third embodiment of the present invention will be described with a focus laid on different points from those of the first embodiment and the second embodiment.

Figure 3:
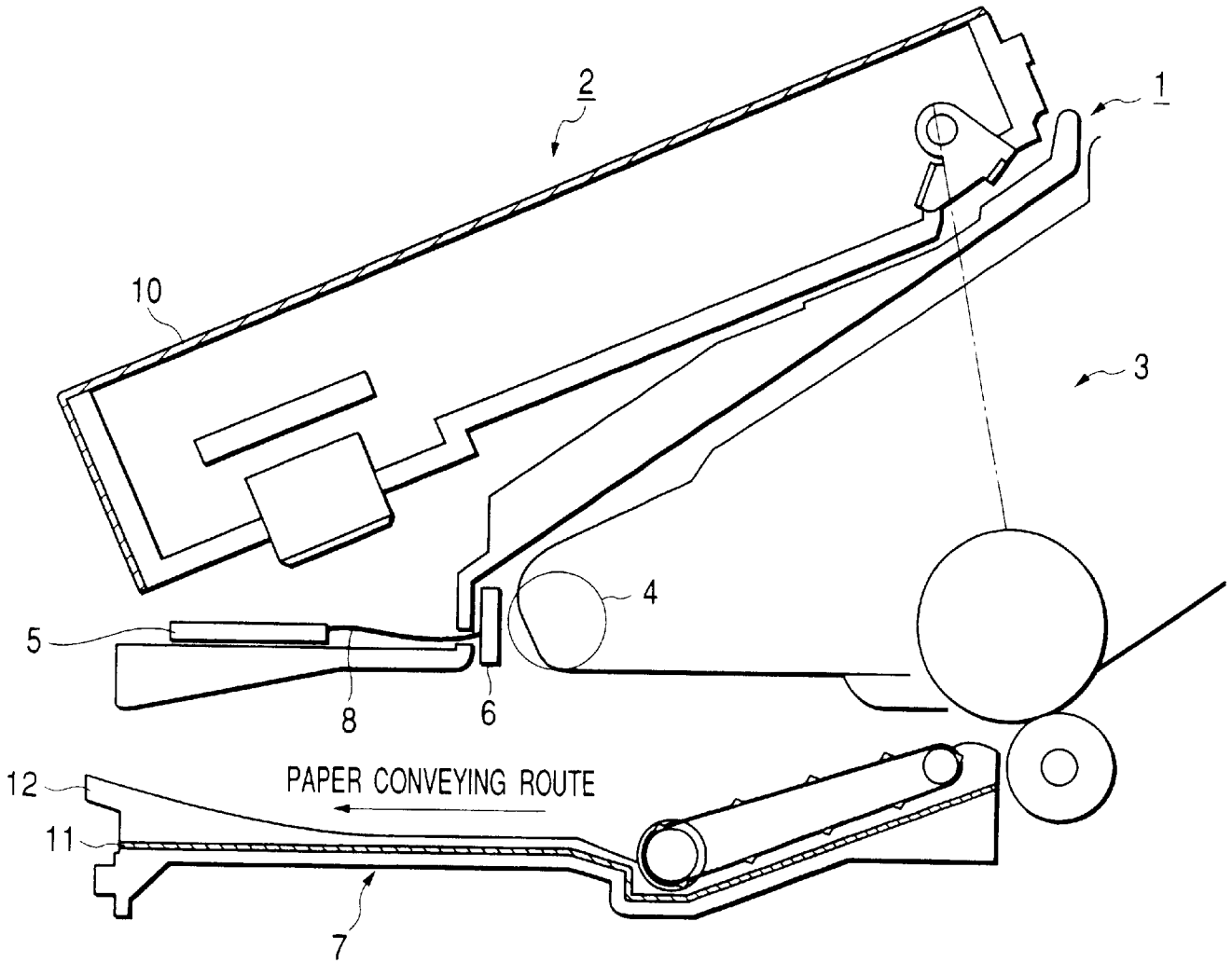
FIG. 3 is a laterally sectional view schematically showing a periphery of a toner cartridge memory part according to a third embodiment of the present invention.

FIG. 3 is a laterally sectional view schematically showing a toner cartridge memory part according to the third embodiment of the present invention.

Figure 7:
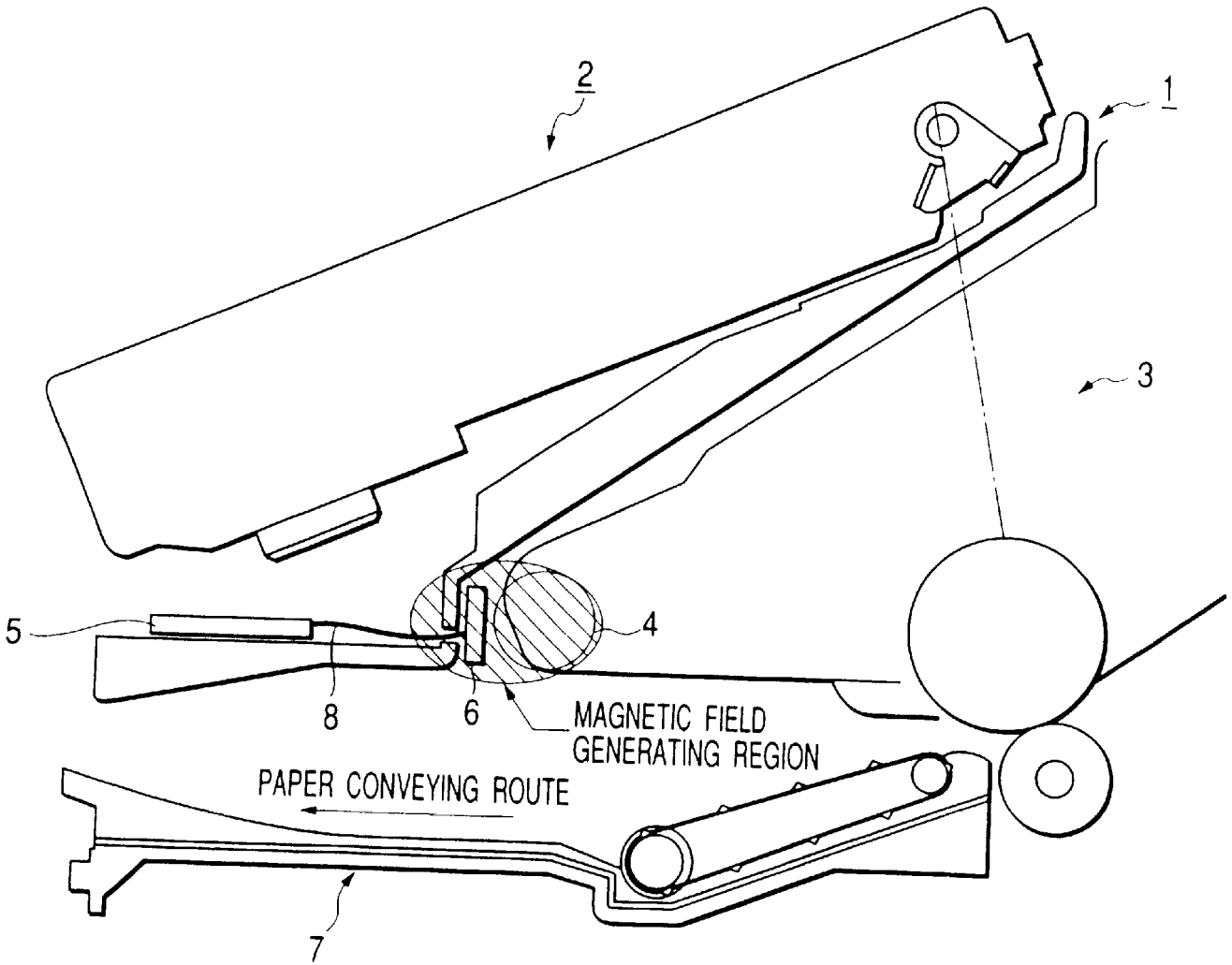
PRIOR ART FIG. 7
FIG. 7 is a laterally sectional view schematically showing a periphery of a toner cartridge memory part in a conventional image forming apparatus.

Incidentally, also with respect to the apparatus of the second embodiment shown in FIG. 3, the same reference symbols are attached to those similar in function and structure to constituents of the conventional image forming apparatus described in FIG. 7 and the detailed description thereof will be omitted here.

In the configuration of the scanner unit 2 according to the present embodiment, the upper member 10 of a scanner unit part 2 is made of a sheet metal. The upper member 10 is electrically connected to an unillustrated ground connection. The read/write circuit substrate 5 is arranged at the lower part in the projective plane of the scanner unit 2 and between the scanner unit 2 and the paper conveying route. Furthermore, a convey guide 7 constituting the paper conveying route has a sheet metal 11 at its part. This sheet metal 11 electrically connected to an unillustrated ground connection. When charged and conveyed along this conveying route, the sheet material is spontaneously attracted because of being charged and thus conveyed stably, then conveyed in contact with a mould member 12 but not with the sheet metal 11 of the convey guide unit 7. If this mould member 12 not used, an insulating film becomes necessary for the sheet metal. According to these constitutions, the radiant noise generated from the read/write circuit substrate 5, specifically a emitter element for outputting a high-frequency current, is reduced by means of a sheet metal 10 opposed to the arranged plane of the high-frequency element of the read/write circuit substrate 5 and a sheet metal 11 so arranged on the opposite surface as to be opposed.

In this embodiment, a sheet metal of the upper member 10 was employed for the upper member of the scanner unit, but even application of an arrangement similar to that of the first embodiment can take an effect equivalent to or almost equal to that of this embodiment.

Fourth Embodiment

Next, the fourth embodiment of the present invention will be described with a focus laid on different points from those of the first, second and third embodiments.

Figure 4:
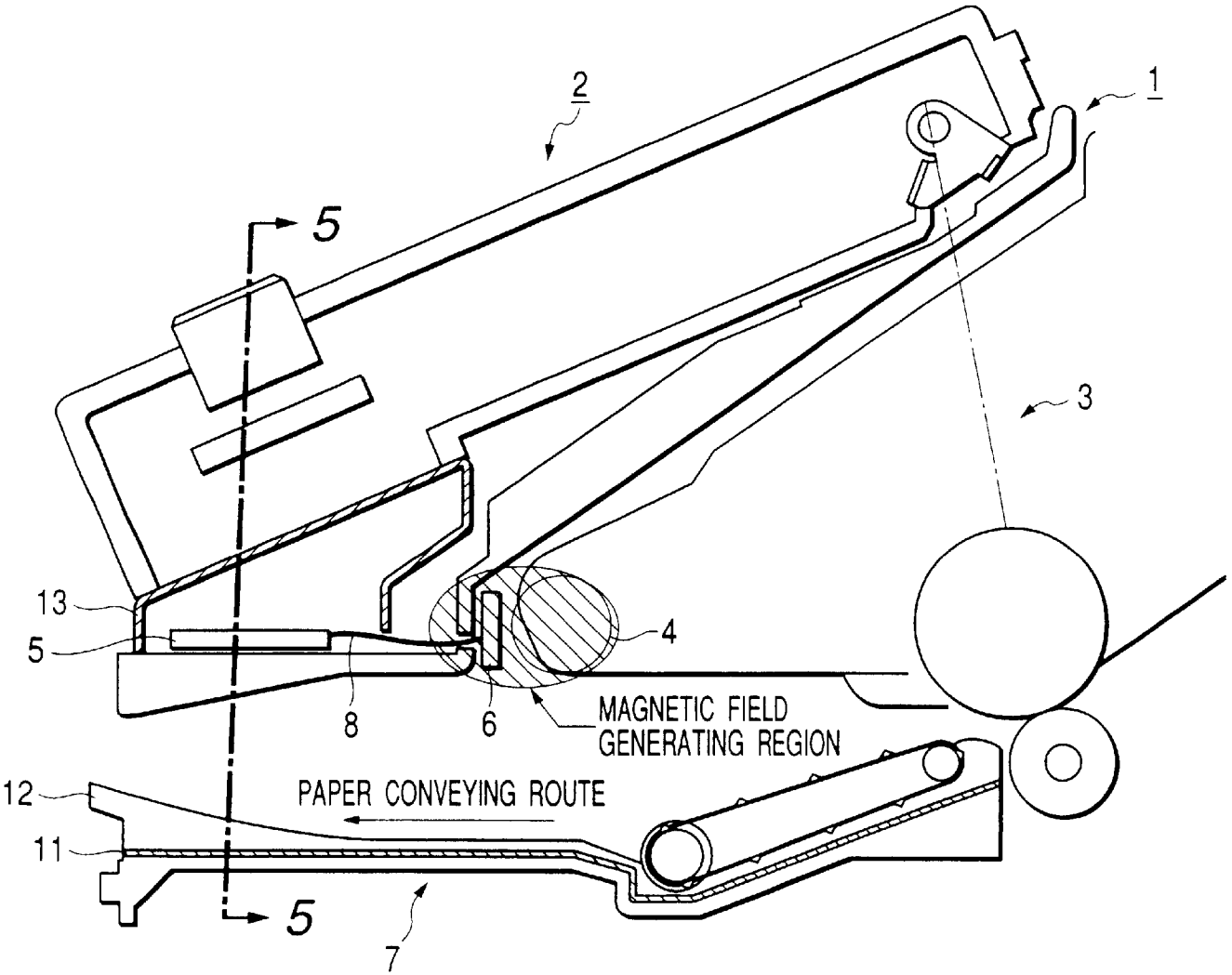
FIG. 4 is a laterally sectional view schematically showing a periphery of a toner cartridge memory part according to a fourth embodiment of the present invention.
Figure 5:
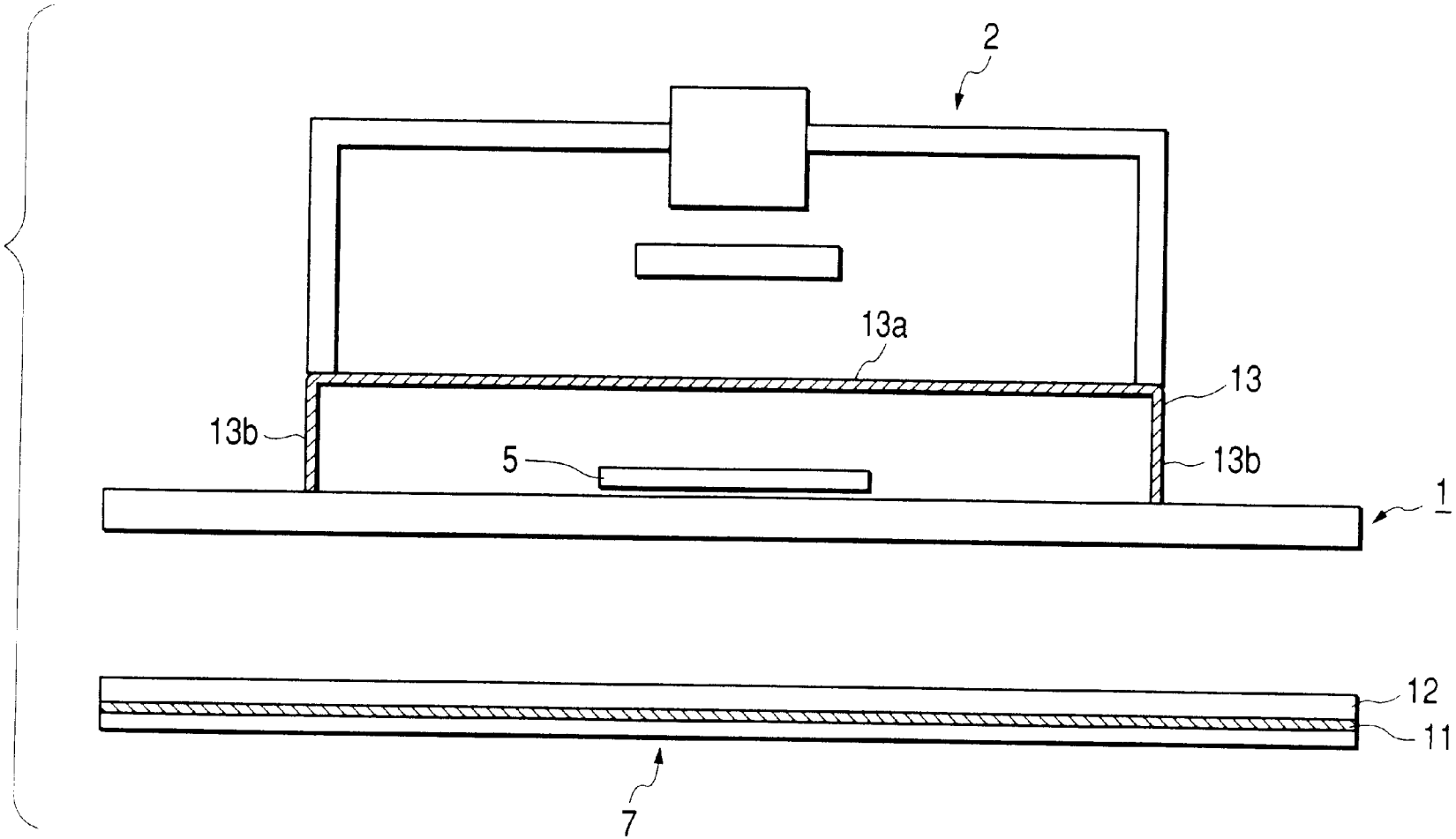
FIG. 5 is a sectional view of the periphery of the toner cartridge memory part shown in FIG. 4.

FIG. 4 is a laterally sectional view schematically showing the periphery of a toner cartridge memory part provided at an image forming apparatus according to a fourth embodiment of the present invention and FIG. 5 is a sectional view of the illustrated place of the toner cartridge memory part shown in FIG. 4. By the way, also with respect to the apparatus of the fourth embodiment shown in FIGS. 4 and 5, the same reference symbols are attached to those similar in function and structure to constituents of the conventional image forming apparatus described in FIG. 7 and the detailed description thereof will be omitted here.

In an image forming apparatus 1 according to the present invention, a scanner unit part 2 is equipped with a bottom member 13 made of a sheet metal. The bottom member 13 comprises a lid part covering the upper surface and a lateral part 13*b* covering the flank of the read/write circuit substrate 5 and is so structured as to envelop the whole upper part of the circuit substrate 5. Besides, this bottom member 13 is electrically connected to an unillustrated ground connection. The read/write circuit substrate 5 is situated approximately in the projective plane of the scanner unit 2. When the antenna part 6 and the toner cartridge memory part 4 communicate with each other, a magnetic field is generated around the antenna part 6 and the toner cartridge memory part 4 (magnetic-field generating region is as illustrated). Since the presence of a metal component (conductive component) in this magnetic field disables the communication, the sheet metal situated between the antenna part 6 and the read/write circuit substrate 5 is so located as not situated in this magnetic field.

Furthermore, in an image forming apparatus 1 according to the present invention, a convey guide 7 constituting the paper conveying route has a sheet metal 11 at its part. The sheet metal 11 electrically connected to an unillustrated ground connection. When charged and conveyed along this conveying route, the sheet material 11 is spontaneously attracted because of being charged and thus conveyed stably, then conveyed in contact with a mould member 12 but not with the sheet metal 11 of the convey guide unit 7. If this mould member 12 not used, an insulating film becomes necessary for the sheet metal.

According to these constitutions, the radiant noise generated from the read/write circuit substrate 5 is appropriately reduced by means of a sheet metal 13 of the scanner unit 2 enclosing the periphery of the circuit substrate 5 and a sheet metal member 11 of a convey guide unit.

Figure 6:
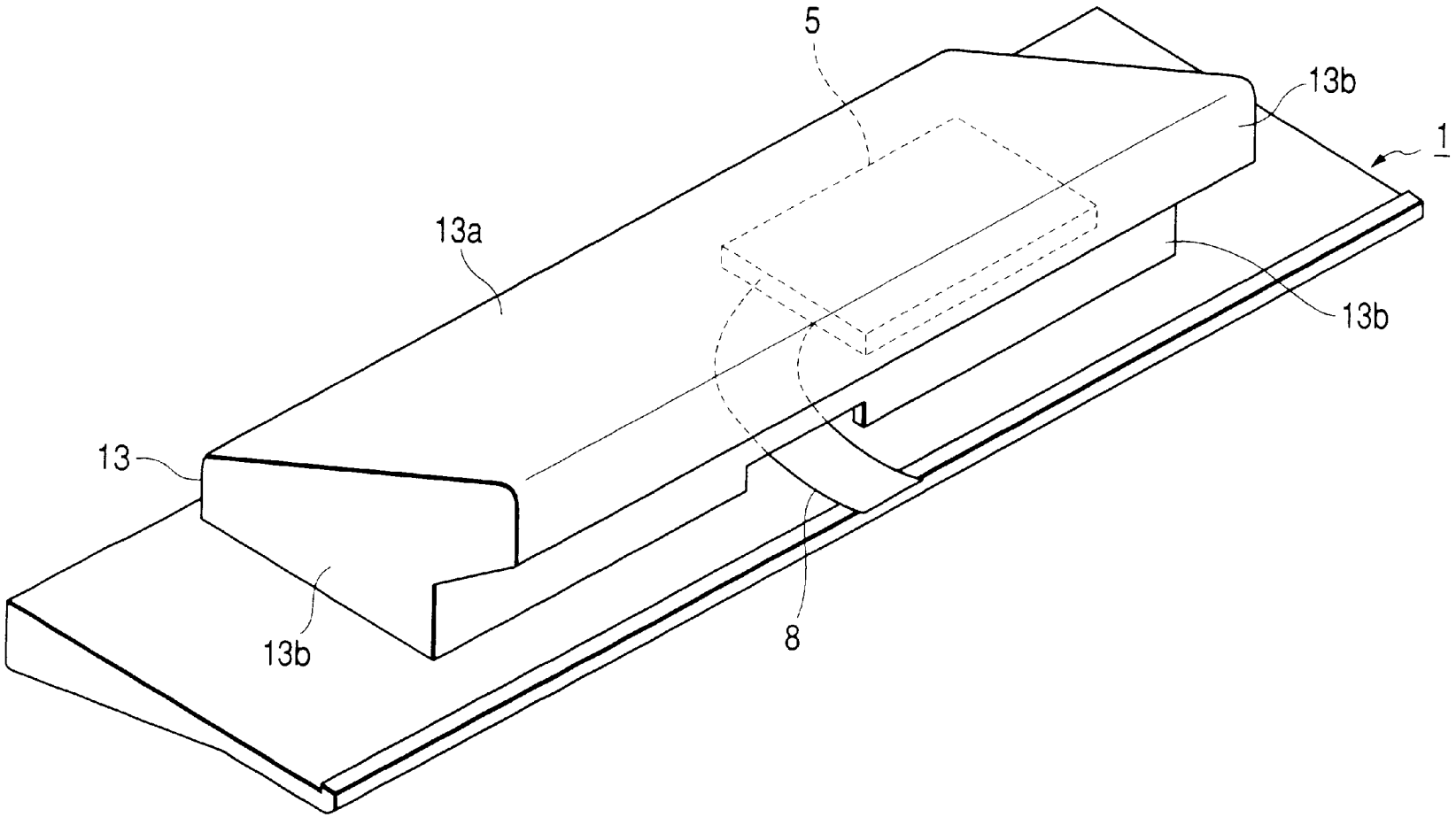
FIG. 6 is a perspective view schematically showing a shield structure of a read/write circuit substrate according to the fourth embodiment.

Besides, locating this read/write circuit substrate 5 at a position, hidden from the space opened in the sheet metal 13 for the cable 8 as shown in FIG. 6, can also reduce the radiant noise still more effectively.

Meanwhile, in the above individual embodiments, a one-piece type apparatus capable of charging, exposing and developing processes was decided to be used as the toner cartridge, but a separable, not one-piece type, toner cartridge may be applicable in place of this.

Besides, in the above individual embodiments, a laser scanner unit was decided to be used as the image exposing means, but an LED, an LCD or an analog copier with the optical support stand may be applicable.

According to the present invention, as described above, locating a read/write circuit substrate in the projective plane of the image exposure means or between the image exposure means and the paper conveying route takes the following effect.

By jointly using the image exposure means or a constituent component of the paper conveying route as the shield member to form a shield structure against radiant noises, the radiant noise generated from the read/write substrate of a storage medium (memory) can be appropriately reduced without newly installing an additive component, or without an additional manufacturing cost.

What is claimed is:

1. An image forming apparatus, comprising:

a unit detachably mountable on a main assembly, said unit having at least an image bearing member and a memory;

image writing means for writing an image on said image bearing member in accordance with image information;

communication means for communicating with said memory; and a guide part arranged under said communication means for guiding movement of a recording material, wherein said communication means is arranged under said image writing means; and wherein said image writing means and said guide part have a shielding function of shielding against radiant noise emitted from said communication means.

2. An image forming apparatus according to claim 1, wherein said image writing means includes a case and wherein said case of said image writing means performs the shielding function.

3. An image forming apparatus according to claim 2, wherein said case is at least partly made of a sheet metal.

4. An image forming apparatus according to claim 2, wherein said case includes a bottom member and wherein a material of said bottom member of said case includes a metal.

5. An image forming apparatus according to claim 2, wherein said case includes a top member and wherein a material of said top member of said case includes a metal.

* * * * *

UNITED STATES PATENT AND TRADEMARK OFFICE

CERTIFICATE OF CORRECTION

PATENT NO. : 6,560,423 B2
DATED : May 6, 2003
INVENTOR(S) : Hideyuki Matsubara

It is certified that error appears in the above-identified patent and that said Letters Patent is hereby corrected as shown below:

Title page,
Item [57], ABSTRACT,
Line 4, “anew” should read -- newly --.
Line 15, “the:” should read -- the --.

Column 1,
Line 55, “an” should read -- a --.

Column 2,
Line 63, “a” should read -- an --.

Column 3,
Line 63, “not” should read -- is not --.
Line 67, “a” (1st occurrence) should read -- an --.

Column 4,
Line 54, “not” should read -- is not --.

Signed and Sealed this

Eighteenth Day of November, 2003

JAMES E. ROGAN
*Director of the United States Patent and Trademark Office*